US005426827A

United States Patent [19]

Tracy et al.

[11] Patent Number: 5,426,827

[45] Date of Patent: Jun. 27, 1995

[54] TENSIONING SYSTEM FOR FLEXIBLE STRAPS

[75] Inventors: Keith P. Tracy, Mequon; William E. Chase, Colgate, both of Wis.

[73] Assignee: Pereles Brothers, Inc., Milwaukee, Wis.

[21] Appl. No.: 24,514

[22] Filed: Mar. 1, 1993

[51] Int. Cl.[6] ..... A44B 21/00

[52] U.S. Cl. ..... 24/68 R; 24/68 CD

[58] Field of Search ..... 24/71.2, 71.3, 68 R, 24/68 CD, 68 F, 68 E, 68 T

[56] References Cited

U.S. PATENT DOCUMENTS

| | | | |
|---|---|---|---|
| Re. 27,170 | 6/1966 | Porter . | |
| D. 299,913 | 2/1989 | Arvidsson . | |
| D. 300,914 | 5/1989 | Arvidsson . | |
| D. 302,000 | 7/1989 | Arvidsson . | |
| 373,017 | 11/1887 | Frost | 24/71.3 |
| 2,434,387 | 1/1948 | Brandt . | |
| 2,720,350 | 10/1955 | Felton . | |
| 3,242,542 | 3/1966 | Tako | 24/71.3 |
| 3,836,058 | 9/1974 | Penniman et al. . | |
| 3,897,895 | 8/1975 | Read . | |
| 4,154,427 | 5/1979 | Hofmann | 24/71.2 |
| 4,278,192 | 7/1981 | Sazegar . | |
| 4,372,470 | 2/1983 | Dallaire . | |
| 4,373,234 | 2/1983 | Boden . | |
| 4,395,796 | 8/1983 | Akaura et al. | 24/68 R |
| 4,396,138 | 8/1983 | Kirschner . | |
| 4,449,656 | 5/1984 | Woudon . | |
| 4,479,674 | 10/1984 | Nordmeyer . | |
| 4,524,893 | 6/1985 | Cole . | |
| 4,530,135 | 7/1985 | Hsiang | 24/68 CD |
| 4,688,706 | 8/1987 | Thulin . | |
| 4,720,031 | 1/1988 | Zimmerman . | |
| 4,809,953 | 3/1989 | Kurita et al. | 24/68 CD |
| 4,842,315 | 6/1989 | Nordmeyer . | |
| 4,877,169 | 10/1989 | Grim . | |
| 4,995,538 | 2/1991 | Marengo . | |
| 4,997,116 | 3/1991 | Grim . | |
| 5,038,988 | 8/1991 | Thulin . | |
| 5,104,020 | 4/1992 | Arvidsson et al. . | |
| 5,115,955 | 5/1992 | Dallaire et al. . | |

FOREIGN PATENT DOCUMENTS

| | | | |
|---|---|---|---|
| 780459 | 7/1957 | United Kingdom | 24/71.2 |

OTHER PUBLICATIONS

Illinois Tool Works "ITW Nexus" catalog, undated.

*Primary Examiner*—Edward K. Look
*Assistant Examiner*—James A. Larson
*Attorney, Agent, or Firm*—Reinhart, Boerner, Van Deuren, Norris & Rieselbach

[57] ABSTRACT

A tensioning member for achieving and maintaining a desired tension in a flexible strap, web or belt is provided. The tensioning member includes an elongate tensioning member having a pair of cam-like cross-members around which the strap is threaded. The elongate member is rotatable through substantially 180° of arc from a release position to a tensioned position. In the tensioned position, the path of the strap through the tensioning member is longer than when the tensioning member is in the release position. This causes the tension in the strap to increase as the tensioning member is rotated from a release position to the tensioned position. One end of the tensioning member is extended to provide a mechanical advantage for rotating the member to the tensioned position. A keeper or retainer encircling the strap and movable therealong engages the extended end of the tensioning member to secure the tensioning member in the tensioned position. Preferably, the tensioning member has a dog-leg shape to hold the tensioned strap away from an underlying surface when the tensioning member is in the tensioned position.

2 Claims, 1 Drawing Sheet

TENSIONING SYSTEM FOR FLEXIBLE STRAPS

BACKGROUND OF THE INVENTION

This invention relates generally to devices for placing and keeping flexible straps, webs and belts under tension.

Flexible straps, belts and webs are widely used in a variety of applications. Such straps are frequently used for securing one object or member to another or for preventing the movement of one object or member relative to another. In such applications, it is necessary to place and keep the strap under tension to ensure security. Depending on the particular application, the failure to achieve or maintain an appropriate tension in the strap can have undesirable consequences.

Typically, a strap is placed under tension by the user who simply pulls on the strap until it is tight. A variety of known retainer devices or clips can then be used to maintain the position of the strap and thereby maintain the tension in the strap. Typically, such retainers and clips engage both sides of a doubled-over strap and function to prevent one side of the doubled-over strap from sliding relative to the other. Although generally effective, slippage can sometimes occur. Furthermore, the resulting tension in the strap depends largely on the strength and care of the person pulling the strap and manipulating the retainer. With such prior techniques, it is difficult to ensure that proper tension is achieved and maintained in the, strap from user to user and from application to application.

SUMMARY OF THE INVENTION

The invention provides a tensioning system for achieving and maintaining tension in a flexible strap. The tensioning system includes an elongate tensioning member having a pair of laterally displaced, substantially parallel cooperating cross-members around and between which the flexible strap is threaded. The tensioning member further includes an extended portion by means of which the tensioning member can be rotated to a tensioned position to shorten the effective length of the strap and thereby increase the tension in the strap. The tensioning system further includes a retainer detachably coupled to the tensioning member for securing the tensioning member in the tensioned position.

It is an object of the present invention to provide a new and improved mechanism for tensioning a flexible strap.

It is another object of the present invention to provide a tensioning member that can produce substantial tension in a flexible strap substantially independently of the strength of the user.

It is still another object of the present invention to provide a tensioning member that securely and reliably provides at least a minimum desired tension in a flexible strap.

It is still another object: of the present invention to provide a tensioning member that is simple and reliable in use and economical in manufacture.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figure 2:
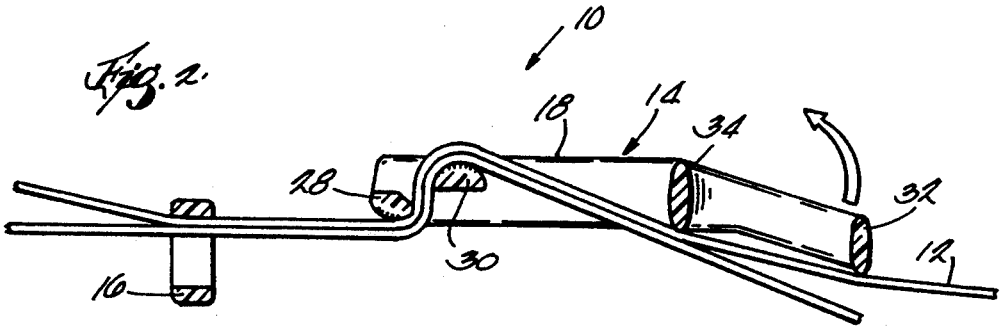
FIG. 2 is a cross-sectional view of the tensioning system shown in FIG. 1 taken along Line 2—2 thereof, showing the system in a non-tensioned or released position.

Referring to the drawings, a system 10 for tensioning a flexible strap 12, such as a flexible synthetic web or belt, is illustrated. The system 10 generally includes an elongate tensioning member 14 that can be manipulated by a user to place the strap 12 under tension. The system 10 further includes a keeper or retainer 16 that can thereafter be used to hold the tensioning member 14 in position and thereby keep the strap 12 under tension.

Figure 3:
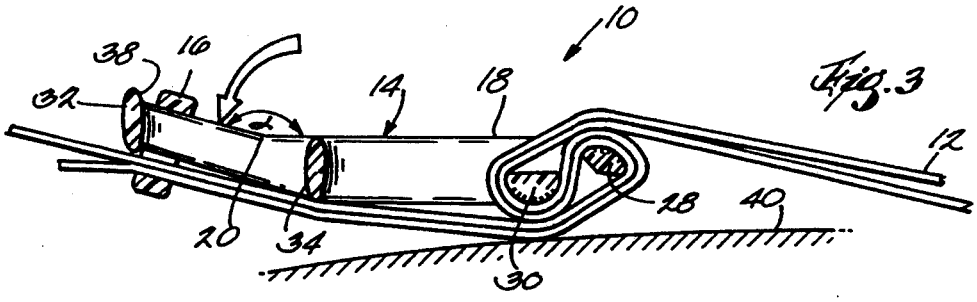
FIG. 3 is a view, similar to FIG. 2, showing the tensioning system in a tensioned position.
Figure 1:
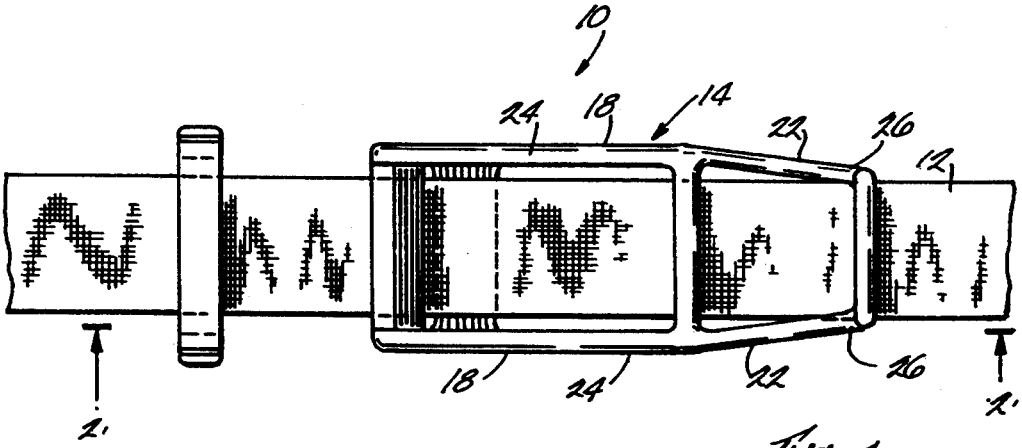
FIG. 1 is a top plan view of a tensioning system embodying various features of the invention.

The tensioning member 14 comprises an elongate structure having two substantially identical side portions or members 18. The side portions 18 are substantially parallel for about two-thirds of their length and then taper gently inwardly toward each other over the remaining third as best seen in FIG. 1. As best seen in FIGS. 2 and 3, the side members 18 preferably have a dog-leg form or shape so as to form an obtuse angle $\alpha$ having a vertex 20 generally located where the tapered portions 22 of the sides meet the parallel portions 24 of the sides. Preferably, the spacing between the sides 18 is such that the closest distance between the inwardly tapered ends 26 of the sides 18 is substantially equal to the width of the strap 12, while the distance between the parallel portions 24 of the sides 18 is slightly greater than the width of the strap 12. As further illustrated, a plurality of cross-members 28, 30, 32, 34 extend perpendicularly between the sides 18 of the tensioning member. Two of the cross-members 28, 30 are located adjacent the ends of the parallel portions 24 of the sides 18. A third cross-member 32 is located at the ends 26 of the tapered portions 22 of the sides 18, while a forth cross-member 34 extends between the sides 18 substantially at the juncture of the tapered and parallel portions 22, 24 thereof. Preferably, the tensioning member 14 is molded as a single, unitary member from a durable, rigid plastic.

Figure 4:
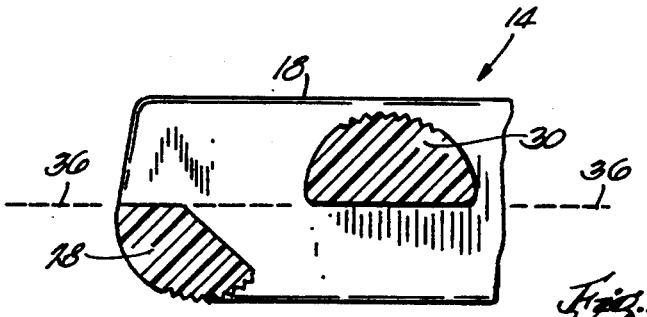
FIG. 4 is an enlarged sectional view of the tensioning member of the tensioning system showing the cooperating cam surfaces thereof.

The two cross-members 28, 30 at the ends of the tensioning member 14 are preferably shaped and dimensioned as best seen in FIG. 4. The outermost cross-member 28 is positioned generally below the mid-line 36 of the side 18 and has an arcuate outer surface. The second cross-member 30 is positioned generally above the mid-line 36 of the side 18 and is spaced inwardly from the end of the side 18 so as not to overlap the first cross-member 28. In cross-section, the second cross-member 30 has a substantially semi-circular shape while the cross-section of the first cross-member 28 is somewhat less than semi-circular.

The third and forth cross-members 32, 34 are of substantially elliptical cross-section as best seen in FIG. 2 and 3. The third cross-member 32 is of somewhat greater width than the side members 18 so as to form an upwardly projecting lip 38 as best seen in FIG. 3. The retainer 16, which is also preferably formed of a molded, durable, rigid plastic, comprises a substantially rectangular loop dimensioned to slide over the tapered end 26 of the tensioning member 14 and the adjacent strap 12.

In use, the flexible strap 12 is threaded through the retainer 16, under the first cross-member 28, over the second cross-member 30 and under the third and forth cross-members 32, 34 as shown in FIG. 2. To place the strap 12 under tension, the tapered end 26 of the tensioning member 14 is rotated in a counter-clockwise direction (as viewed in FIG. 2) through substantially 180° of arc to the position shown in FIG. 3. The interrelationship of the first and second cross-members 28, 30 has a camming effect that shortens the effective length of the strap 12 and thereby substantially increases the tension in the strap 12. The rounded outer surface of the first cross-member 28 serves as a fulcrum around which the entire length of the tensioning member 14 pivots. The length of the tensioning member 14 thereby serves as a lever to provide a mechanical advantage that enables the tension in the strap 12 to be substantially greater than the force applied to the end of the tensioning member. In this sense, the portions of the side members 18 that extend beyond the first and second cross members 28, 30 comprise an extended portion by means of which the tensioning member 14 can be rotated to the tensioned position. Once the tensioning member 14 has been fully rotated to the tensioned position shown in FIG. 3, the retainer 16 is slipped over the end of the tensioning member 14 to hold the tensioning member in place. The lip 38 provided by the cross-member 32, together with the natural tendency of the tensioning member 14 to return to the release position, helps hold the retainer 16 in place to avoid unintended release of the tensioning member 14. To release tension in the strap 12, the retainer 16 is slipped over the end of the tensioning member 14 and the tensioning member 14 is rotated to the release position shown in FIG. 2.

As best seen in FIG. 4, the outer surfaces of the first and second cross-members 28, 30 can be serrated or otherwise roughened to the increase the friction between the cross-members and the strap 12 to avoid slippage.

As will be appreciated by reference to FIG. 3, when the tensioning member 14 is in the tensioned position, the strap 12 is at all times and at all points positioned between the tensioning member 14 and any underlying surface 40. Accordingly,, the tensioning system 10 is particularly well-suited for applications wherein the strap 12 is positioned adjacent a surface that is delicate or that should not be marred. One such application is shown, for example, in the concurrently filed, co-pending application of Tracy, et. al. entitled "Modular Carrier System for Elongate Articles," Ser. No. 08/024,645, wherein the strap 12 is used to secure to a ski carrier or similar structure to the roof of an automobile. The strap 12 thus serves as a buffer between the tensioning member 14 and the roof of the automobile to minimize or prevent marring the automobile's finish. It will also be appreciated that the dog-leg configuration of the tensioning member 14 helps hold the tensioning strap 12 up away from the underlying surface 40 so that contact between the strap 12 and the underlying surface 40 occurs substantially at only one point.

The tensioning system 10 herein shown and described is advantageous in several respects. Because the resulting tension depends primarily on the geometry of the tensioning member and, in particular, on the interrelationship of the first and second cross-members 28, 30, the resulting tension is largely independent of the strength of the user. Furthermore, by varying the effective length of the tensioning member 14, the force needed to rotate the tensioning member to the tensioned position can be made substantially independent of the resulting tension. Because of its inherent simplicity, the system 10 can be economically manufactured from inexpensive molded plastic. It will be appreciated that, although a particular configuration has been shown, the system can be readily adapted for use with straps of different sizes and in applications requiring greater or lesser amounts of tension. In this regard, it will be appreciated that the resulting tension can be controlled by controlling the size, shape and relative orientations of the first and second cross-members 28, 30. Accordingly, the example herein shown and described is intended to be illustrative rather than limiting.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. A tensioning system for achieving and maintaining tension in a flexible strap positioned adjacent an underlying surface, said tensioning system comprising:

an elongate tensioning member having a pair of laterally displaced substantially parallel cooperating cross members around and between which the flexible strap can be threaded for sliding movement relative to said tensioning member when the flexible strap is not tensioned and further including an extended portion by means of which the tensioning member can be rotated to a tensioned position to shorten the effective length of the strap and thereby increase the tension in the strap; and a retainer detachably coupled to the tensioning member for securing the tensioning member in the tensioned position;

said tensioning member including a pair of substantially parallel side members each having a dog-leg form;

said cooperating cross members being non-movable relative to the side members extending perpendicularly between said side members adjacent one end of said side members;

said dog-leg form of said tensioning member thereby serving to ensure that the flexible strap is positioned between all points of said tensioning member and the underlying surface so that direct contact between said tensioning member and the underlying surface is substantially avoided.

2. A tensioning system as defined in claim 1 wherein said tensioning member further includes an additional cross member extending between said side members adjacent the other end thereof.

* * * * *